US007959450B1

(12) United States Patent
Wang et al.

(10) Patent No.: US 7,959,450 B1
(45) Date of Patent: Jun. 14, 2011

(54) ELECTRICAL CONNECTOR

(75) Inventors: Yao-Ting Wang, Taipei (TW); Yu-Hung Su, Taipei (TW)

(73) Assignee: Cheng Uei Precision Industry Co., Ltd., Taipei (TW)

( * ) Notice: Subject to any disclaimer, the term of this patent is extended or adjusted under 35 U.S.C. 154(b) by 0 days.

(21) Appl. No.: 12/870,141

(22) Filed: Aug. 27, 2010

(51) Int. Cl.
*H01R 13/44* (2006.01)

(52) U.S. Cl. ..... 439/135

(58) Field of Classification Search ..... 439/626, 439/733.1, 660, 629, 630, 607.01, 607.54, 439/79, 135
See application file for complete search history.

(56) References Cited

U.S. PATENT DOCUMENTS 7,112,075 B1 * 9/2006 Su ..... 439/159
7,150,651 B1 * 12/2006 Yuan et al. ..... 439/607.54

* cited by examiner

*Primary Examiner* — Javaid Nasri
(74) *Attorney, Agent, or Firm* — WPAT, P.C.; Anthony King

(57) ABSTRACT

An electrical connector includes an insulating body having a mouth and fastening passages connected with the mouth, first terminals disposed in the fastening passages with soldering tails stretching into the mouth and abutting against the bottom side of the mouth, and a lid mounted in the mouth. The lid has a restraining board abutting against a front side of the mouth to seal up the fastening passages for stopping solder flowing forward along the fastening passages, and a plurality of separating arms protruding rearward from a bottom of the restraining board and spaced from one another along a length direction of the restraining board to abut against the bottom side of the mouth. The soldering tails are respectively restrained between two adjacent separating arms and separated by the separating arms to make easier for being soldered with cables and avoid a short circuit among the soldering tails.

8 Claims, 4 Drawing Sheets

ELECTRICAL CONNECTOR

BACKGROUND OF THE INVENTION

1. Field of the Invention

The present invention relates to an electrical connector, and more particularly to an electrical connector capable of stopping solder flowing forwards to damage a contact arm of a terminal thereof.

2. The Related Art

A conventional electrical connector includes an insulating body and a plurality of terminals. The insulating body has a base portion and a tongue portion extending forward from the base portion. The insulating body defines a plurality of fastening passages each extending along a front-to-rear direction to penetrate through the base portion and a top of the tongue portion for receiving the corresponding terminal therein. The terminal has a contact arm projecting upward out of the respective fastening passage opened in the top of the tongue portion, and a soldering tail stretching rearward beyond the base portion for being soldered with a cable. However, the fastening passage is opened without any obstruction. As a result, when the soldering tail is soldered with the cable, the solder is apt to flow into the fastening passage to damage the contact arm. Moreover, the soldering tails are hanged in the air, so it is difficult to solder the cables onto the corresponding soldering tails, and the soldering tails are apt to be short circuited in process of soldering the cables and the soldering tails together.

SUMMARY OF THE INVENTION

It is an object of the present invention to provide an electrical connector which includes an insulating body, a plurality of first terminals and a lid. The insulating body has a base portion and a tongue portion extending forward from a bottom of the base portion. A mouth is opened in a rear of the base portion. The base portion defines a plurality of fastening passages arranged at regular intervals along a transverse direction thereof and each extending longitudinally to penetrate through the base portion and communicate with the mouth. A top of the tongue portion defines a plurality of receiving fillisters each aligned with one of the fastening passages and connected with a front end of the corresponding fastening passage. The first terminal has a fastening slice secured in the fastening passage of the insulating body, a first contact arm and a soldering tail connected with two opposite ends of the fastening slice. The first contact arms are received in the corresponding receiving fillisters. The soldering tails stretch into the mouth and abut against a bottom side of the mouth apart from one another. The lid is mounted in the mouth of the insulating body. The lid has a restraining board and a plurality of separating arms protruding rearward from a bottom of a rear face of the restraining board and spaced from one another along a length direction of the restraining board to abut against the bottom side of the mouth. Wherein the soldering tails are respectively restrained between two adjacent separating arms and separated by the separating arms to make easier for being soldered with external cables and further avoid a short circuit among the soldering tails. Furthermore, the restraining board abuts against a front side of the mouth to seal up the fastening passages for stopping solder flowing into the receiving fillisters along the fastening passages.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
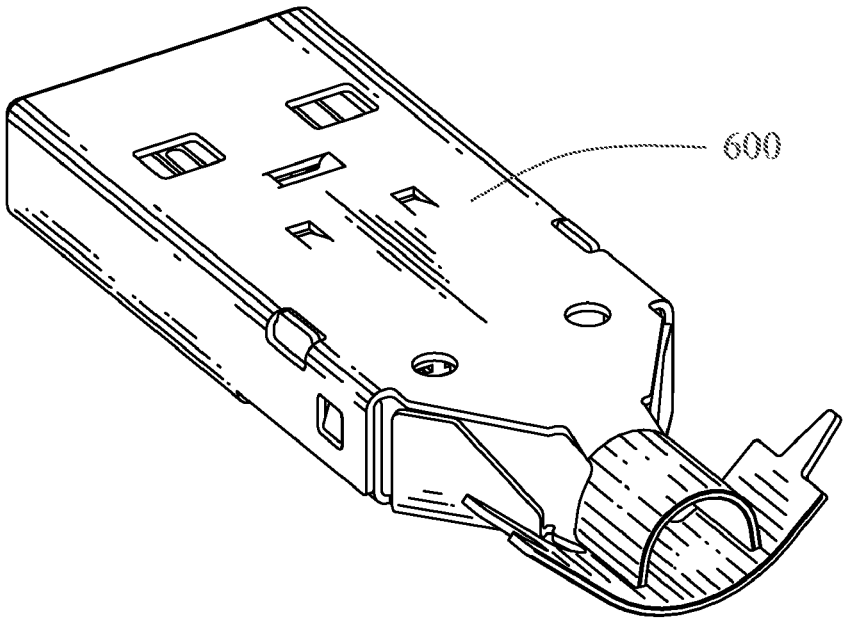
FIG. 1 is a perspective view of an electrical connector in accordance with the present invention.
Figure 2:
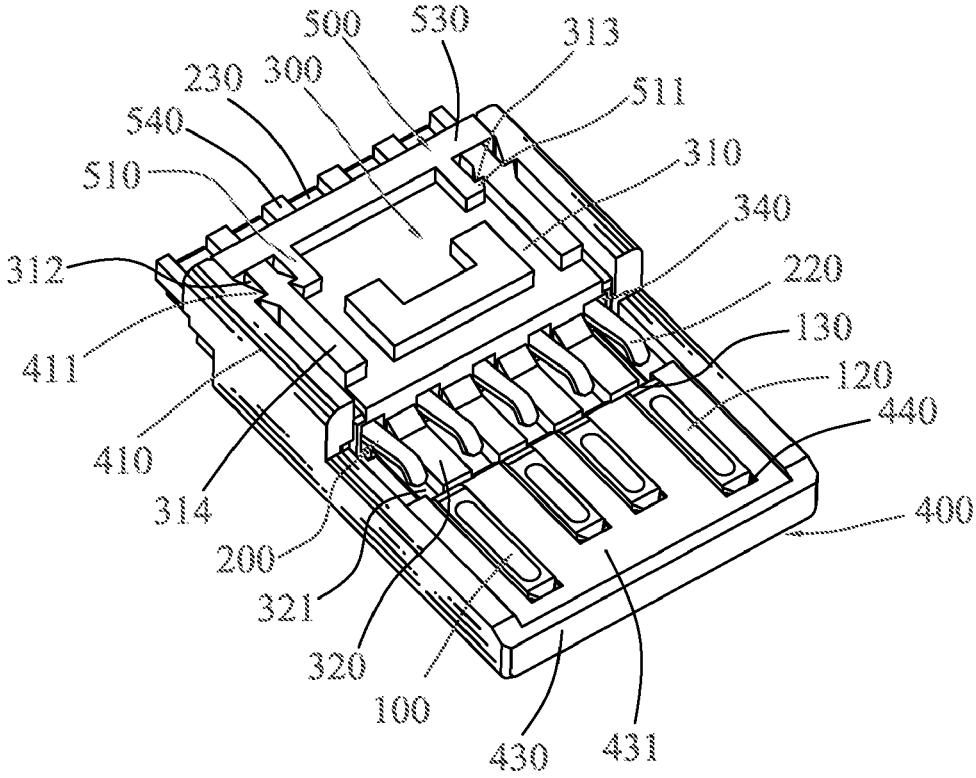
FIG. 2 is a perspective view of the electrical connector of FIG. 1 except a shielding shell.
Figure 3:
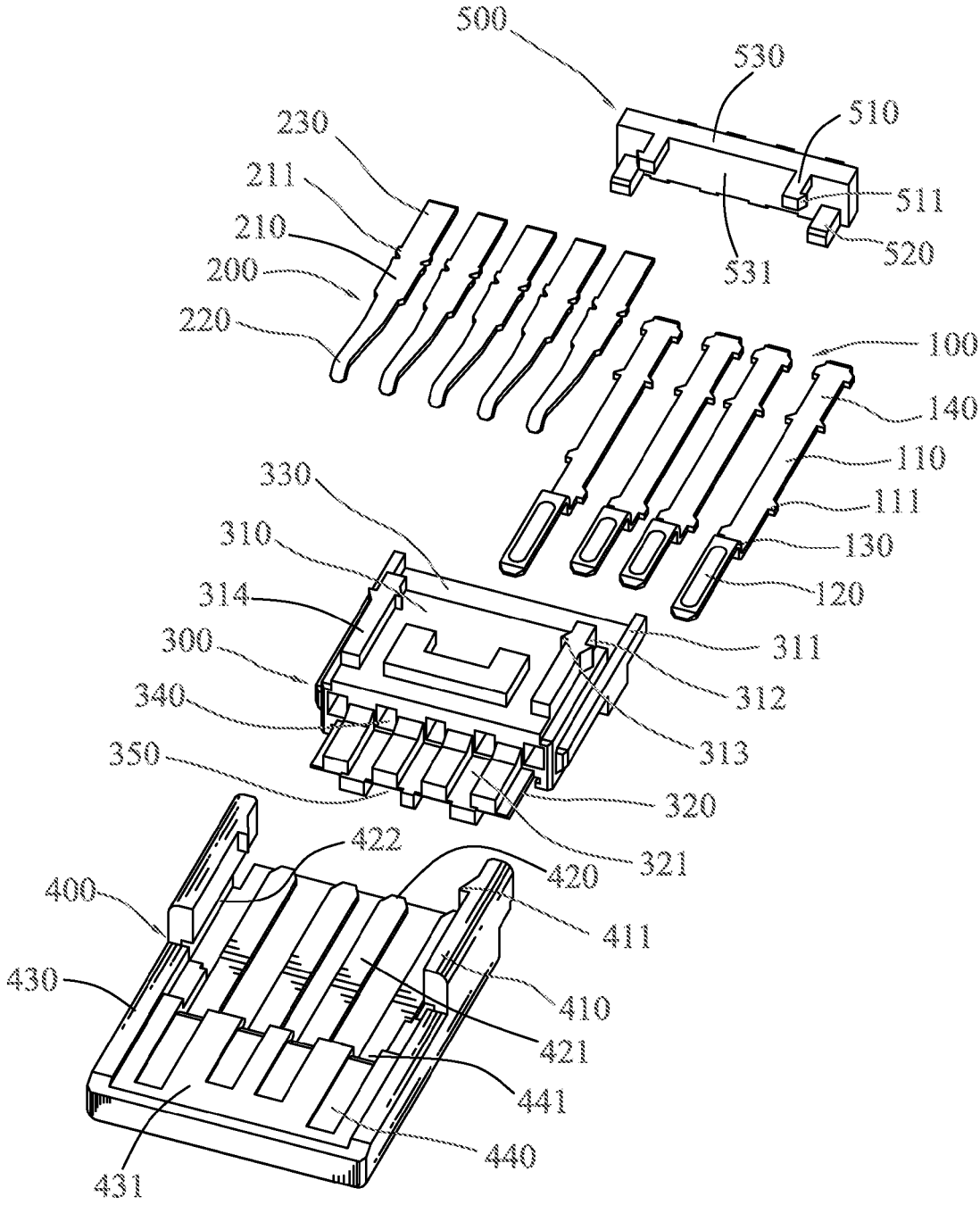
FIGS. 3-5 are exploded perspective views of the electrical connector without the shielding shell of FIG. 2 viewed from three different angles.

Referring to FIG. 1, FIG. 2 and FIG. 3, an electrical connector according to the present invention includes an insulating housing 400, an insulating body 300 mounted to the insulating housing 400, a plurality of second terminals 100 disposed in the insulating body 300 and propped by the insulating housing 400, a plurality of first terminals 200 disposed in the insulating body 300, a lid 500 mounted to a rear of the insulating body 300 for securing and separating the first terminals 200, and a shielding shell 600 surrounding the insulating body 300, the insulating housing 400 and the lid 500.

Figure 4:
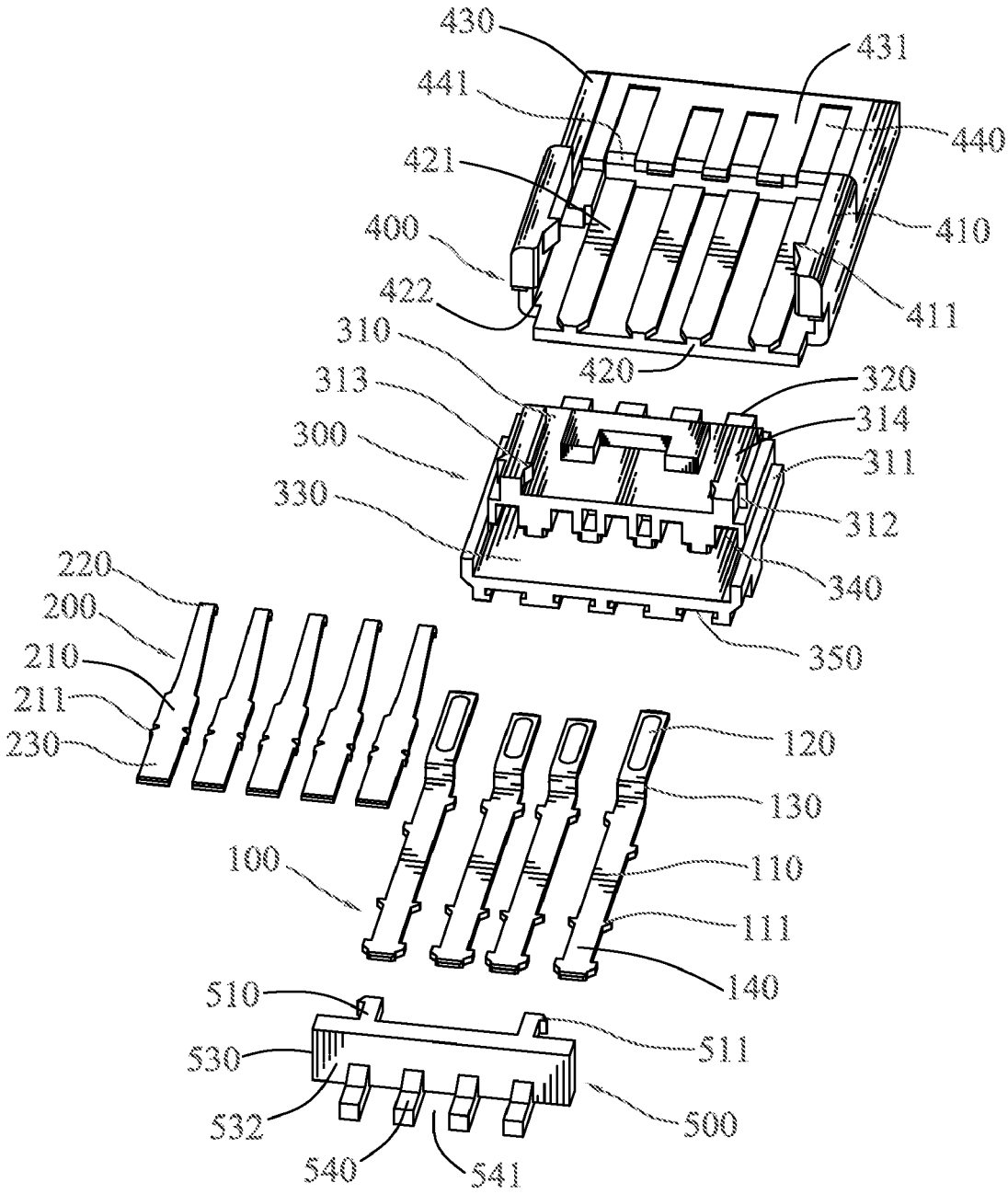
Figure 5:
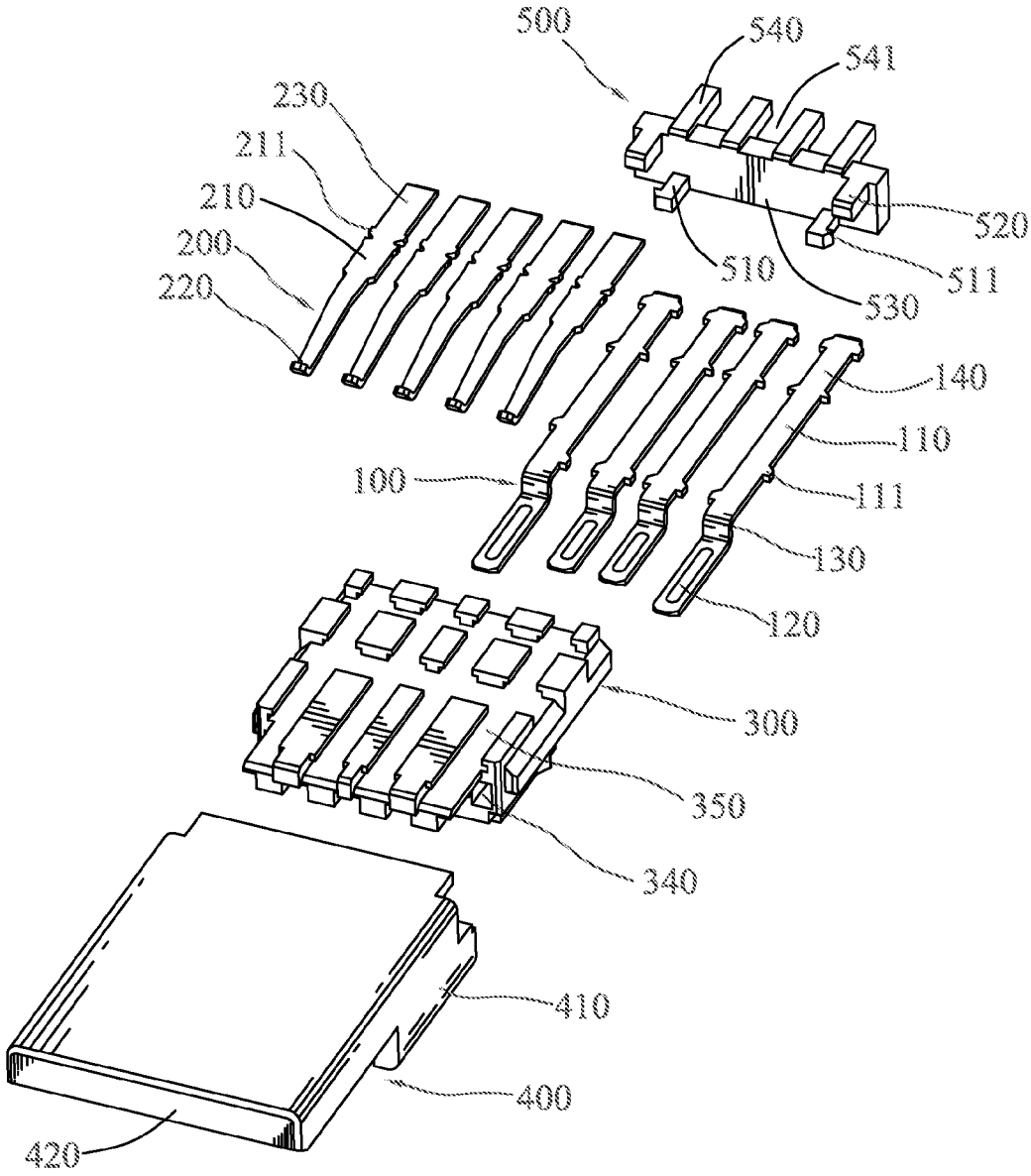

Referring to FIGS. 3-5, the insulating housing 400 has a rectangular base board 430 and a rectangular tongue board 420 which is formed by the base board 430 stretching rearward from a bottom of a rear thereof. Two opposite side edges of the tongue board 420 protrude upward beyond a top surface 431 of the base board 430 to form a pair of clipping walls 410 which define a receiving space 421 therebetween. Tops of rear ends of the pair of clipping walls 410 protrude towards each other to form a pair of buckling barbs 411. A restraining channel 422 is opened in a lower portion of an inside of the clipping wall 410 to communicate with the receiving space 421, and extends longitudinally with a rear end thereof being opened freely. The top surface 431 of the base board 430 defines a plurality of receiving cavities 440 arranged at regular intervals along a transverse direction thereof, and each extending longitudinally with a rear end thereof further spread vertically to form a positioning passage 441 which communicates with the receiving space 421.

The insulating body 300 has a rectangular base portion 310 and a tongue portion 320 which is formed by the base portion 310 stretching forward from a bottom of a front thereof. A mouth 330 is opened in a rear end of a top of the base portion 310, for receiving the lid 500 therein. The base portion 310 defines a plurality of fastening passages 340 arranged at regular intervals along a transverse direction thereof, and each extending longitudinally to penetrate through the base portion 310 and communicate with the mouth 330. A top of the tongue portion 320 defines a plurality of receiving fillisters 321 corresponding to the fastening passages 340 and each extending longitudinally to be connected with a front end of the corresponding fastening passage 340. A bottom of the insulating body 300 defines a plurality of fastening cavities 350 each extending longitudinally to penetrate through the base portion 310 and the tongue portion 320. The fastening cavities 350 are arranged to alternate with the fastening passages 340 along a transverse direction of the insulating body 300 so as to make a front end of the tongue portion 320 substantially look like a rectangular pulse shape. A pair of restraining ribs 311 oppositely protrudes outward from lower portions of two opposite sides of the base portion 310 and each extends longitudinally to match with the restraining channel 422 of the insulating housing 400. Two opposite sides of the top of the base portion 310 protrude upward to form a pair of protrusion ribs 314 each extending longitudinally with a buckling gap 312 opened in a rear end of an outside thereof and a locking wedge 313 protruded at an inside thereof.

Referring to FIGS. 2-5, each of the first terminals 200 has a fastening slice 210, a first contact arm 220 and a first soldering tail 230 which are connected with two opposite ends of the fastening slice 210. The first contact arm 220 is slanted upward beyond a plane of the fastening slice 210 and has a free end slightly bent downward. Two opposite side edges of the fastening slice 210 oppositely protrude to form a pair of first fastening barbs 211. The fastening slice 210 of the first terminal 200 is secured in the corresponding fastening passage 340 of the insulating body 300 by means of the first fastening barbs 211 abutting against two opposite sides of the respective fastening passage 340. The first contact arm 220 projects upward out of the corresponding receiving fillister 321 and can be pressed in the receiving fillister 321 when electrically connecting with a mating connector. The first soldering tails 230 stretch into the mouth 330 and are against a bottom side of the mouth 330 apart from one another.

Each of the second terminals 100 has a fastening strip 110 and a second contact arm 120 which is connected with one end of the fastening strip 110 in a step manner by a connecting portion 130. The other end of the fastening strip 110 extends towards a direction opposite to the second contact arm 120 to form a second soldering tail 140. A plurality of second fastening barbs 111 is provided at two opposite side edges of the fastening strip 110 and spaced from one another. The fastening strip 110 and the second soldering tail 140 of the second terminal 100 are secured in the corresponding fastening cavity 350 of the insulating body 300 by means of the second fastening barbs 111 abutting against two opposite sides of the respective fastening cavity 350. The second contact arm 120 projects beyond the front end of the tongue portion 320 with the connecting portion 130 abutting against the front end of the tongue portion 320.

Referring to FIG. 2, FIG. 3 and FIG. 4 again, the lid 500 has a restraining board 530, a pair of inserting arms 520 protruding forward from a bottom of a front face 531 of the restraining board 530, a pair of locking arms 510 protruding forward from a top of the front face 531 of the restraining board 530, and a plurality of separating arms 540 which protrude rearward from a bottom of a rear face 532 of the restraining board 530 and are spaced from one another along a length direction of the restraining board 530 to define a plurality of restraining passages 541. The restraining passage 541 further penetrates through a bottom of the restraining board 530. The inserting arms 520 are spaced from each other along the length direction of the restraining board 530, and have an interval therebetween equal to the one between outmost two fastening passages 340 of the insulating body 300. The locking arms 510 are spaced from each other along the length direction of the restraining board 530, with an interval between two opposite outsides of the pair of locking arms 510 being substantially equal to that between the locking wedges 313 of the insulating body 300. Two free ends of the pair of locking arms 510 oppositely protrude outward to form two locking barbs 511. When the lid 500 is mounted to the rear of the insulating body 300, the restraining board 530 and the separating arms 540 are located in the mouth 330 and abut against the bottom side of the mouth 330 so as to restrain the first soldering tails 230 of the first terminals 200 in the restraining passages 541 respectively, wherein the first soldering tails 230 are separated by the separating arms 540 so that not only facilitate the first soldering tails 230 to be soldered with external cables (not shown) but also avoid a short circuit among the first soldering tails 230. The restraining board 530 further abuts against a front side of the mouth 330 and seals up the fastening passages 340 so as to stop solder flowing into the receiving fillisters 321 along the fastening passages 340. The inserting arms 520 are inserted in the outmost two fastening passages 340 to further press tightly the corresponding fastening slices 210 in the respective fastening passages 340. The locking arms 510 are disposed on the top of the base portion 310 and clamped between the protrusion ribs 314, and the locking barbs 511 are grappled by the locking wedges 313 respectively to secure the lid 500 and the insulating body 300 together.

Referring to FIG. 2 again, when the insulating body 300 is assembled to the insulating housing 400, the insulating body 300 is firstly inserted forward to make the tongue portion 320 received in the receiving space 421, and the restraining ribs 311 inserted into the corresponding restraining channels 422. Then the insulating body 300 keeps on being pushed forward to make the restraining ribs 311 slide forward along the corresponding restraining channels 422 until the front end of the tongue portion 320 abuts against the rear of the base board 430. At this time, the base portion 310 is received in the receiving space 421 and clipped between the clipping walls 410. The buckling barbs 411 are buckled in the buckling gaps 312 respectively to prevent the insulating body 300 from moving rearward, and the restraining ribs 311 are restrained in the corresponding restraining channels 422, so that make the insulating body 300 firmly assembled in the insulating housing 400. The connecting portions 130 of the second terminals 100 are positioned in the corresponding positioning passages 441 and further restrained by the front end of the tongue portion 320. The second contact arms 120 are disposed in the corresponding receiving cavities 440 and project beyond the top surface 431 of the base board 430.

As described above, the electrical connector can effectively stop solder flowing into the receiving fillister 321 along the fastening passage 340, by means of the lid 500 being mounted in the mouth 330 and abutting against the front side of the mouth 330 to seal up the fastening passages 340. Furthermore, the restraining board 530 and the separating arms 540 abut against the bottom side of the mouth 330 to restrain the first soldering tails 230 in the restraining passages 541 and make the first soldering tails 230 separated by the separating arms 540, so that not only facilitate the first soldering tails 230 to be soldered with the cables but also avoid a short circuit among the first soldering tails 230.

What is claimed is:

1. An electrical connector, comprising:

an insulating body having a base portion and a tongue portion extending forward from a bottom of the base portion, a mouth being opened in a rear of the base portion, the base portion defining a plurality of fastening passages arranged at regular intervals along a transverse direction thereof and each extending longitudinally to penetrate through the base portion and communicate with the mouth, a top of the tongue portion defining a plurality of receiving fillisters each aligned with one of the fastening passages and connected with a front end of the corresponding fastening passage;

a plurality of first terminals each having a fastening slice secured in the fastening passage of the insulating body, a first contact arm and a soldering tail connected with two opposite ends of the fastening slice, the first contact arms being received in the corresponding receiving fillisters, the soldering tails stretching into the mouth and abutting against a bottom side of the mouth apart from one another; and a lid mounted in the mouth of the insulating body, the lid having a restraining board and a plurality of separating arms protruding rearward from a bottom of a rear face of the restraining board and spaced from one another along a length direction of the restraining board to abut against the bottom side of the mouth, the soldering tails being respectively restrained between two adjacent separating arms and separated by the separating arms to make easier for being soldered with external cables and further avoid a short circuit among the soldering tails, the restraining board abutting against a front side of the mouth to seal up the fastening passages for stopping solder flowing into the receiving fillisters along the fastening passages.

2. The electrical connector as claimed in claim 1, wherein two opposite sides of a top of the base portion protrude upward to form a pair of protrusion ribs each extending longitudinally with a locking wedge protruded at an inside thereof, a top of a front face of the restraining board protrudes forward to form a pair of locking arms spaced from each other along the length direction of the restraining board and clamped between the protrusion ribs, two free ends of the pair of locking arms oppositely protrude outward to form two locking barbs grappled by the locking wedges respectively to secure the lid and the insulating body together.

3. The electrical connector as claimed in claim 2, wherein a bottom of the front face of the restraining board protrudes forward to form two inserting arms spaced from each other along the length direction of the restraining board, the inserting arms are inserted in two of the fastening passages to restrain the corresponding fastening slices in the respective fastening passages and further secure the lid and the insulating body together.

4. The electrical connector as claimed in claim 1, further comprising an insulating housing and a plurality of second terminals, the insulating housing having a base board and a tongue board extending rearward from a bottom of the base board, the insulating body being disposed on the tongue board and abutting against the base board, the second terminal having a fastening strip secured in a bottom of the insulating body and a second contact arm connected with the fastening strip in a step manner by a connecting portion, the connecting portion being restrained between the tongue portion and the base board, and the second contact arm projecting beyond a front end of the tongue portion to be positioned on the base board.

5. The electrical connector as claimed in claim 4, wherein two opposite sides of the base portion are respectively provided with a buckling gap at a top thereof, two opposite sides of the tongue board protrude upward to form a pair of clipping walls of which tops protrude towards each other to form a pair of buckling barbs, the base portion is clipped between the clipping walls and the buckling barbs are buckled in the buckling gaps.

6. The electrical connector as claimed in claim 5, wherein a restraining channel is opened in a lower portion of an inside of the clipping wall and extends longitudinally with a rear end thereof being opened freely, lower portions of two opposite sides of the base portion oppositely protrudes outward to form two restraining ribs each extending longitudinally to slide along the corresponding restraining channels and be restrained in the corresponding restraining channels.

7. The electrical connector as claimed in claim 4, wherein a plurality of fastening barbs is provided at two opposite side edges of the fastening strip and fastened in the insulating body for securing the second terminals to the insulating body.

8. The electrical connector as claimed in claim 1, wherein two opposite side edges of the fastening slice oppositely protrude to form a plurality of fastening barbs abutting against two opposite sides of the respective fastening passage to secure the first terminal in the insulating body.

* * * * *